US008893342B2

(12) United States Patent
Rissik

(10) Patent No.: US 8,893,342 B2
(45) Date of Patent: Nov. 25, 2014

(54) APPARATUS FOR CLEANING SWIMMING POOL SURFACES

(75) Inventor: George Victor Rissik, Gauteng Province (ZA)

(73) Assignee: Arengo 309 (Pty) Limited, Primrose, Germiston (ZA)

( * ) Notice: Subject to any disclaimer, the term of this patent is extended or adjusted under 35 U.S.C. 154(b) by 564 days.

(21) Appl. No.: 12/513,131

(22) PCT Filed: Oct. 25, 2007

(86) PCT No.: PCT/IB2007/003201

§ 371 (c)(1),
(2), (4) Date: Apr. 30, 2009

(87) PCT Pub. No.: WO2008/053298

PCT Pub. Date: May 8, 2008

(65) Prior Publication Data

US 2010/0064455 A1 Mar. 18, 2010

(30) Foreign Application Priority Data

Oct. 30, 2006 (ZA) ..... 06/8246

(51) Int. Cl.
*E04H 4/16* (2006.01)

(52) U.S. Cl.
CPC ..... *E04H 4/1663* (2013.01)
USPC ..... 15/1.7

(58) Field of Classification Search
USPC ..... 15/1.7, 404, 377, 381, 354, 409, 400, 15/419, 350; 134/183
See application file for complete search history.

(56) References Cited

U.S. PATENT DOCUMENTS

| | | | | | |
|---|---|---|---|---|---|
| 3,310,173 | A * | 3/1967 | Sosower | 210/167.12 |
| 3,928,202 | A * | 12/1975 | Raubenheimer | 210/167.15 |
| 4,434,519 | A * | 3/1984 | Raubenheimer | 15/1.7 |
| 4,642,833 | A * | 2/1987 | Stoltz et al. | 15/1.7 |
| 4,761,848 | A * | 8/1988 | Hofmann | 15/1.7 |
| 6,463,614 | B1 * | 10/2002 | Supra | 15/1.7 |
| 2005/0283935 | A1 * | 12/2005 | Sebor | 15/246 |

FOREIGN PATENT DOCUMENTS

| | | | |
|---|---|---|---|
| FR | 2604351 | A1 * | 4/1988 |
| WO | WO 9851888 | A1 * | 11/1998 |

* cited by examiner

*Primary Examiner* — Lee D Wilson
*Assistant Examiner* — Tyrone V Hall, Jr.
(74) *Attorney, Agent, or Firm* — Fulbright & Jaworski LLP

(57) ABSTRACT

An underwater pool surface cleaning apparatus is provided comprising a suction head, a driving component spaced apart from the suction head, the driving component being arranged to move the apparatus underwater along a surface, and a first flexible hose to connect the suction head and the driving component together. In an example embodiment, a second flexible hose may be fitted to the driving component so as to join the driving component to a swimming pool filtration system. According to another aspect of the invention there is provided a driving component for an underwater cleaning apparatus. The driving component may comprise a body defining a chamber, a first end and a second end, with a valve arrangement being housed within the body. The valve arrangement is arranged to close and open so as to cause the apparatus to move.

10 Claims, 1 Drawing Sheet

APPARATUS FOR CLEANING SWIMMING POOL SURFACES

FIELD OF THE INVENTION

This invention relates to an underwater cleaning apparatus, and in particular to an apparatus for cleaning the surfaces of swimming pools and the like.

BACKGROUND TO THE INVENTION

Typical pool cleaners for cleaning the surfaces of swimming pools comprise a suction head and a working mechanism that are both housed within a body. The body is in turn connected to an inlet of a swimming pool filtration system by means of a flexible hose, with the working mechanism being arranged to move the body of the pool cleaner, in a well known manner, across the surface to be cleaned.

However, a problem associated with such pool cleaners is that the body of the cleaner tends to be relatively bulky, which makes it difficult for them to access certain areas or regions of the pool, such as steps and corners. Previous attempts to address this 3D problem have typically involved reducing the overall size of the apparatus, so as to make them less bulky and therefore more flexible in Its movements. These attempts have been limited in their success, since, to operate properly and efficiently, pool cleaners with the above general configuration can only be reduced to a certain extent.

OBJECT OF THE INVENTION

It is therefore an object of this invention to provide a cleaning apparatus that is smaller, less bulky and more flexible, when compared to existing pool cleaners, so as to address the problems outlined above.

SUMMARY OF THE INVENTION

According to a first aspect of the invention there is provided an underwater cleaning apparatus comprising:

a suction head;

a driving component spaced apart from the suction head, the driving component being arranged to move the apparatus underwater along a surface; and a first flexible hose to connect the suction head and the driving component together.

In an example embodiment, a second flexible hose may be fitted to the driving component so as to join the driving component to a filtration system.

In an example embodiment, the suction head comprises a flexible footplate that can glide along an underwater surface, with an aperture being defined by the footplate that in turn defines an inlet for allowing water to be sucked into and through the apparatus.

In an example embodiment, the suction head further comprises a connector that is fitted to the footplate, the connector comprising a first end that is arranged to be in fluid communication with the aperture defined in the footplate.

In an example embodiment, the connector comprises a second end that is arranged to be connected to a first end of the first flexible hose.

In an example embodiment, the second end of the connector is angled relative to the flexible footplate.

According to a second aspect of the invention there is provided a driving component for an underwater cleaning apparatus, the driving component comprising:

a body defining a chamber, a first end and a second end, the first end being connectable to a first flexible hose that in turn is connectable to a suction head so as to separate, in use, the driving component from the suction head, the second end being connectable to a second flexible hose, the second flexible hose in turn being connectable to a filtration system; and a valve arrangement housed within the body, the valve arrangement being arranged to close and open so as to cause the apparatus, when connected, to move.

In an example embodiment, the valve arrangement comprises a diaphragm.

BRIEF DESCRIPTION OF THE DRAWINGS

One embodiment of the invention will be described, by way of example only, with reference to the drawings in which.

DETAILED DESCRIPTION OF THE INVENTION

Figure 1:
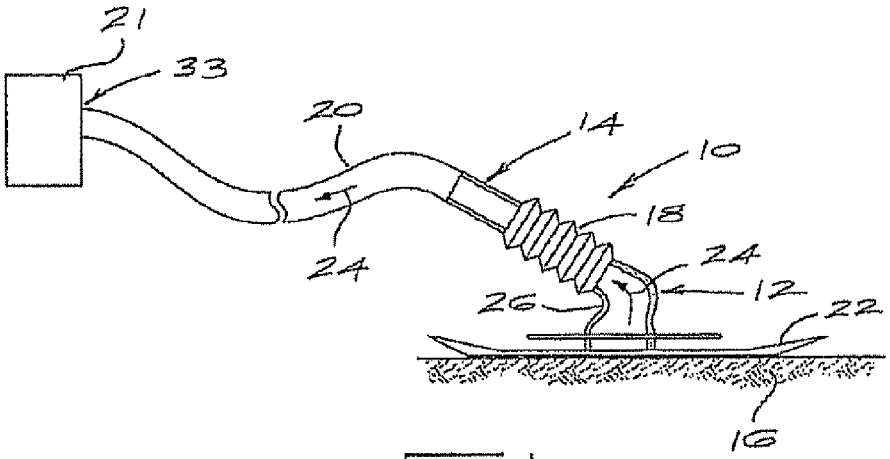
FIG. 1 shows a sectional elevation of an underwater pool surface cleaning apparatus according to an example embodiment.

Referring to the attached figures, an underwater pool surface cleaning apparatus 10 comprises a suction head 12 and a spaced apart driving component 14. The driving component 14 is arranged to move the apparatus 10 underwater along a surface 16 of a pool. The driving component 14 will be described in more detail further below with reference to FIG. 2.

The suction head 12 and the spaced apart driving component 14 are joined together by a first flexible hose 18. A second flexible hose 20 may be fitted to the driving component 14 so as to join the driving component 14 to a swimming pool filtration system 21. The second flexible hose 20 thus acts as a conduit between the apparatus 10 and the filter 21.

The suction head 12 comprises a flexible footplate 22 that can glide along the pool's surface 16. An aperture (not shown) is defined by the footplate 22, the aperture defining an inlet for allowing water to be sucked into and through the apparatus 10, as indicated by arrows 24.

The suction head 12 further comprises a connector 26 that is fitted to the footplate 22, the connector 26 terminating in a first end that is arranged to be in fluid communication with the aperture defined in the footplate 22. The connector 26 terminates in a second end that is arranged to be connected to a first end of the first flexible hose 18. In an example embodiment, the second end of the connector 26 is angled relative to the flexible footplate 22, as clearly shown in FIG. 1.

The first flexible hose 18 may be made from a conventional ribbed hose and may have varying lengths. However, in an example embodiment, the first flexible hose 18 may range between 20 and 30 cm.

Similarly, a second end of the first flexible hose 18 may be fitted to a first end 28 of the driving component 14, with a second end 30 of the driving component 14 being connected to a first end 32 of the second flexible hose 20. As indicated above, a second end 33 of the second flexible hose 20 may be fitted to the swimming pool filter 21.

Figure 2:
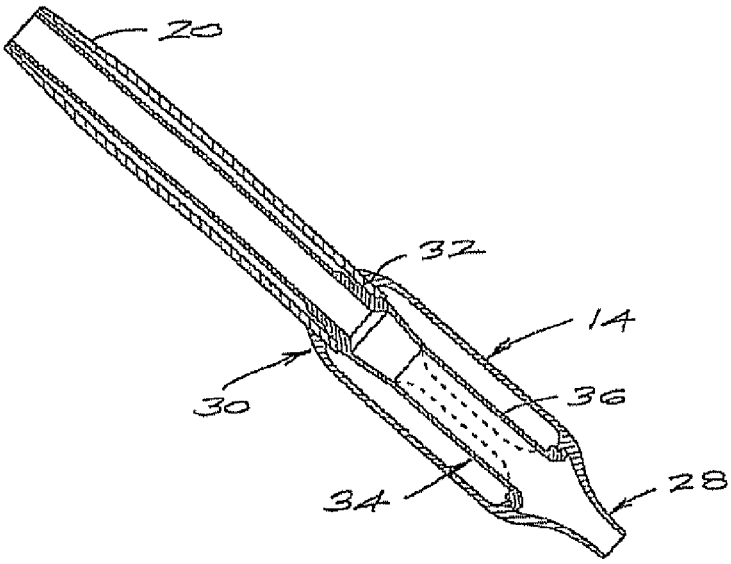
FIG. 2 shows a cross-sectional view of a driving component used in the apparatus shown in FIG. 1, the driving component extending between two flexible hoses and being arranged to move the apparatus underwater.

Turning now specifically to FIG. 2, the driving component 14 defines a chamber 34 that can accommodate a valve arrangement 36. In the illustrated example embodiment, the valve arrangement 36 takes the form of a diaphragm 36 that can rapidly, alternately close and open when suction is applied to the flexible hose 20 by the pool filter. This causes the apparatus 10 to move, in a well known manner, and will thus not be described in more detail. As will be readily appreciated by a person skilled in the art, the valve arrangement 36 may take a number of different configurations, with a diaphragm being used merely as one example.

The disclosed invention thus provides a cleaning apparatus for automatically cleaning a submerged surface. Significantly, the suction head of the apparatus is separated from the driving component by a flexible hose so as to make the overall apparatus less bulky, smaller and able to access and exit areas not previously accessible with conventional pool cleaner apparatuses.

The invention claimed is:

1. An underwater cleaning apparatus comprising:

a suction head comprising a flexible footplate configured to glide along an underwater surface, the footplate having a substantially planar portion that defines an aperture through which water can be sucked into the apparatus, the suction head further comprising a connector that is fitted to the footplate, the connector comprising a first end that is arranged to be in fluid communication with the aperture defined in the footplate;

a driving component spaced apart from the suction head, the driving component being arranged to move the apparatus underwater along a surface; and a first flexible hose to connect the suction head and the driving component together;

the driving component comprising:

a body defining a chamber, a first end and a second end, the first end being connectable to the first flexible hose; and a valve arrangement housed within the body, the valve arrangement being arranged to close and open so as to cause the apparatus to move.

2. The underwater cleaning apparatus of claim 1, wherein a second flexible hose is configured to be fitted to the second end of the driving component so as to join the driving component to a filtration system.

3. The underwater cleaning apparatus of claim 1, wherein the connector comprises a second end that is arranged to be connected to a first end of the first flexible hose.

4. The underwater cleaning apparatus of claim 3, wherein the connector has a first segment adjacent to the first end and a second segment between the first segment and the second end, the first segment having a central, longitudinal first axis, and the second segment having a central, longitudinal second axis that is disposed at a non-parallel angle to the first axis.

5. The driving component of claim 1, wherein the valve arrangement comprises a diaphragm.

6. An underwater cleaning apparatus comprising:

a suction head comprising a flexible footplate configured to glide along an underwater surface, the footplate defining an aperture through which water can be sucked into the apparatus, the suction head further comprising a connector that is fitted to the footplate, the connector comprising:

a first end that is arranged to be in fluid communication with the aperture defined in the footplate, a first segment adjacent to the first end and having a having a central, longitudinal first axis, and a second segment between the first segment and the second end, and having a central, longitudinal second axis that is disposed at a non-parallel angle to the first axis;

a driving component spaced apart from the suction head, the driving component being arranged to move the apparatus underwater along a surface; and a first flexible hose to connect the suction head and the driving component together;

the driving component comprising:

a body defining a chamber, a first end and a second end, the first end being connectable to the first flexible hose; and a valve arrangement housed within the body, the valve arrangement being arranged to close and open so as to cause the apparatus to move.

7. The underwater cleaning apparatus of claim 6, wherein a second flexible hose is configured to be fitted to the second end of the driving component so as to join the driving component to a filtration system.

8. The underwater cleaning apparatus of claim 6, wherein the connector comprises a second end that is arranged to be connected to a first end of the first flexible hose.

9. The underwater cleaning apparatus of claim 8, wherein the connector has a first segment adjacent to the first end and a second segment between the first segment and the second end, the first segment having a central, longitudinal first axis, and the second segment having a central, longitudinal second axis that is disposed at a non-parallel angle to the first axis.

10. The driving component of claim 6, wherein the valve arrangement comprises a diaphragm.

* * * * *

UNITED STATES PATENT AND TRADEMARK OFFICE

CERTIFICATE OF CORRECTION

PATENT NO. : 8,893,342 B2
APPLICATION NO. : 12/513131
DATED : November 25, 2014
INVENTOR(S) : Rissik It is certified that error appears in the above-identified patent and that said Letters Patent is hereby corrected as shown below:

In the Claims,

In Claim 6, on column 4, line 15, remove “having a”.

Signed and Sealed this
Seventh Day of April, 2015

Michelle K. Lee

Michelle K. Lee
*Director of the United States Patent and Trademark Office*